US006112682A

United States Patent [19]

Van Bruggen et al.

[11] Patent Number: 6,112,682

[45] Date of Patent: Sep. 5, 2000

[54] EMBROIDERY PANELS HOLDING MECHANISM AND CHANGING SYSTEM

[75] Inventors: Marv L. Van Bruggen; Duane A. Boyer; Dale D. Oltmans, all of Orange City, Iowa

[73] Assignee: American Identity, Orange City, Iowa

[21] Appl. No.: 09/426,014

[22] Filed: Oct. 25, 1999

[51] Int. Cl.[7] ..... D05C 9/04; D06C 3/08

[52] U.S. Cl. ..... 112/103; 112/470.14; 112/475.07; 38/102.4

[58] Field of Search ..... 112/103, 102.5, 112/470.14, 475.07; 38/102.4; 223/DIG. 2

[56] References Cited

U.S. PATENT DOCUMENTS

| | | | |
|---|---|---|---|
| 3,345,964 | 10/1967 | Palmer . | |
| 4,357,885 | 11/1982 | Stockton . | |
| 4,598,488 | 7/1986 | Inteso | 112/103 X |
| 4,682,551 | 7/1987 | Toman . | |
| 4,993,333 | 2/1991 | Moore, III . | |
| 5,363,785 | 11/1994 | Conley, Jr. . | |
| 5,413,057 | 5/1995 | Moore, III . | |

*Primary Examiner*—Peter Nerbun
*Attorney, Agent, or Firm*—Larson & Taylor, PLC

[57] ABSTRACT

An embroidery panels holding mechanism and an embroidery panels changing system for an automated embroidery machine are provided. The holding mechanism holds a plurality of panels at predetermined positions corresponding to the positions of the ganged embroidery stations of the embroidery machine. The holding mechanism includes an elongate base plate having an upper face, a plurality of elongate clamp bars extending axially and spaced along the upper face, a mounting device for mounting each the clamp bar for movement toward and away from the upper face, and a spring for biasing each clamp bar against the upper face. A changing table remote from the embroidery machine includes a changing station at which embroidery panels already embroidered are individually exchanged for embroidery panels to be embroidered. This table includes an elongate track on which the base plate is received for movement therealong. A retaining device retains the base plate immovably along the track when each clamp bar in turn is located at the changing station. A lifting device is then used for moving the clamp bar at the changing station (a) away from the upper face and against the biasing device so that an embroidery panel already embroidered can be removed therebetween and an embroidery panel to be embroidered can be placed between the lifted the clamp bar and the upper face and (b) back against the upper face so that the panel to be embroidered is trapped therebetween.

17 Claims, 3 Drawing Sheets

EMBROIDERY PANELS HOLDING MECHANISM AND CHANGING SYSTEM

FIELD OF THE INVENTION

The present invention relates generally to an apparatus for automated embroidery machines, and more particularly to an embroidery panels holding mechanism and panels changing system for such machines.

BACKGROUND OF THE INVENTION

Automated embroidery machines have a plurality of ganged embroidery stations at which respective panels in hoops or the like are embroidered at the same time. Typical machines have 20 or 24 ganged stations. After embroidering, the machine must be stopped and each panel removed and replaced with a new panel. This changing is a time consuming process, during which the machines must necessarily be idle and hence unproductive.

SUMMARY OF THE INVENTION

In accordance with the present invention, an embroidery panels holding mechanism and an embroidery panels changing system for an automated embroidery machine are provided. The holding mechanism includes an elongate base plate having an upper face. A plurality of pairs of associated and spaced holding posts are mounted axially along the upper face of the base plate with the associated holding posts extending upwardly from the upper face. Two associated and spaced clamp posts are mounted axially along the upper face of the base plate between the associated holding posts of each pair with the clamp posts extending upwardly from the upper face and having a respective head. An elongate clamp bar extends axially along the upper face of the base plate between the associated holding posts of each pair with the clamp bar being mounted for sliding movement upwardly along associated clamp posts. A drive post is mounted to each clamp bar between each of the two associated clamp posts with the drive posts extending upwardly from the associated clamp bar and having a respective head. Finally, a clamp spring is mounted between the heads of associated ones of the clamp posts and spring posts. With this construction, the clamp bar is biased against the upper face of the base plate to hold an embroidery panel in place therebetween, and is movable away from the upper face against the biasing of the clamp spring to release the embroidery panel for changing thereof.

In a preferred embodiment of the holding mechanism, each clamp bar includes a plurality of pins extending toward the upper face of the base plate which pierce the embroidery panel when the clamp bar is biased against the upper face. Consistent therewith, the base plate includes a plurality of holes in which the pins of each the clamp bar are received.

The embroidery panels changing system includes a similar holding mechanism. This holding mechanism holds a plurality of panels at predetermined positions corresponding to the positions of the ganged embroidery stations of the embroidery machine. The holding mechanism includes an elongate base plate having an upper face, a plurality of elongate clamp bars extending axially and spaced along the upper face of the base plate, a mounting means for mounting each the clamp bar for movement toward and away from the upper face, and a biasing means for biasing each the clamp bar against the upper face.

The changing system further includes a changing table remote from the embroidery machine having a changing station at which embroidery panels already embroidered can be removed from the holding mechanism and embroidery panels to be embroidered can be placed in the holding mechanism. This table includes an elongate track on which the base plate is received for movement therealong. A retaining means retains the base plate immovably along the track with each clamp bar in turn located at the changing station. A lifting means is then used for moving the clamp bar at the changing station (a) away from the upper face of the base plate and against the biasing means so that an embroidery panel already embroidered can be removed therebetween and an embroidery panel to be embroidered can be placed between the lifted clamp bar and the upper face and (b) back against the upper face so that the panel to be embroidered is trapped therebetween.

In a preferred embodiment of the embroidery panels changing system, the base plate includes two spaced lift holes provided beneath each the clamp bar, and the lifting means includes an actuator attached to an underside of the table at the changing station. This actuator has a plunger and two spaced lift rods attached thereto, so that movement of the plunger upwards causes the lift rods to pass through the lift holes and engage an underside of the clamp bar to raise the clamp bar. With this configuration, the elongate track is preferably a slot in the table along which the base plate is manually moved. Then, the lift rods are returned by the actuator to a position where tips of the lift rods remain in the slot to act as locating detents in conjunction with the lift holes of the base plate as the base plate is manually moved along the slot.

In the preferred embodiment, the retaining means includes first and second actuators located on opposite axial sides of the changing station. Each actuator then includes a plunger which extends downwards to press the base plate against the table and thus to hold the base plate immovably along the track. In addition, the base plate preferably includes first and second holding posts mounted to the base plate on opposite axial sides of each clamp bar so that associated first and second holding posts extending upwardly from the upper face are spaced to be engaged by the plungers of the respective first and second actuators when an associated clamp bar is at the changing station.

Also in the preferred embodiment, each clamp bar includes depending pins for engaging an associated panel. In addition, the table further includes an actuator having a plunger which engages the clamp bar after the clamp bar is moved back against the upper face with the panel to be embroidered therebeneath to drive the pins into the panel to be embroidered. Preferably, the base plate also includes a plurality of holes in which the pins of each the clamp bar are received.

Further in the preferred embodiment, the mounting means of the holding mechanism includes, for each associated the clamp bar, two associated and spaced clamp posts mounted axially along the upper face of the base plate. These clamp posts extend upwardly from the upper face through the associated the clamp bar and have a respective head. In addition, the biasing means includes, for each associated the clamp bar, a bent spring located between the respective heads of the clamp posts and the associated the clamp bar.

It is an advantage of the present invention that a holding mechanism for embroidery panels is provided which is quickly and easily changed.

It is also an advantage of the present invention that the embroidery panels are securely held to an elongate base plate.

It is a further advantage of the present invention that the holding mechanism is easily loaded into and unloaded out of the automated embroidery machine. Thus, while one set of holding mechanisms are having the associated held panels thereof embroidered, another set of holding mechanisms are having embroidered panels removed therefrom and un-embroidered panels exchanged therefor. This allows a quick change of just holding mechanisms when the panels being embroidered are finished, lowering the down time of the automated embroidery machine.

Other features and advantages of the present invention are stated in or apparent from detailed descriptions of presently preferred embodiments of the invention found hereinbelow.

DESCRIPTION OF THE PREFERRED EMBODIMENTS

Figure 1:
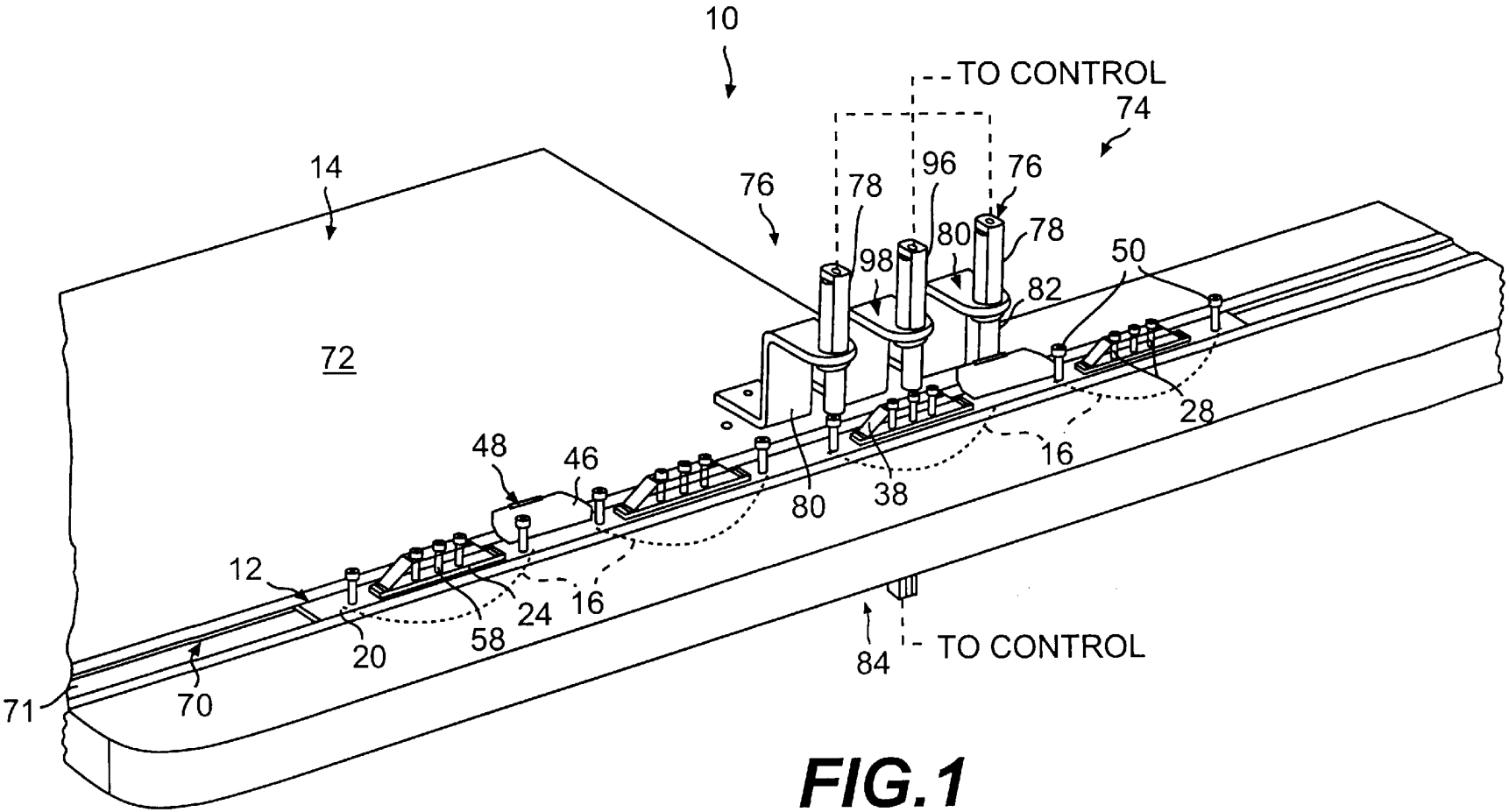
FIG. 1 is a schematic perspective view of the embroidery panels changing system of the present invention.

With reference now to the drawings in which like numerals represent like elements throughout the views, an embroidery panels changing system 10 according to the present invention is schematically depicted in FIG. 1. Changing system 10 broadly includes an embroidery panels holding mechanism 12 and a changing table 14. Holding mechanism 12 is shown with four embroidery panels 16 which are depicted in phantom lines for clarity. In use, it will be appreciated that a set of holding mechanisms 12 is placed into a prior art automated embroidery machine (not forming a part of the invention, and hence not shown) having a plurality of ganged embroidery stations at which panels 16 are individually embroidered. Typically, the automated embroidery machine has twenty or twenty-four ganged stations, so that each holding mechanism 12 holds, for convenience of easy manipulation during changing, some number of panels such as the four as shown. Obviously, six panels could also be held by providing a slightly longer holding mechanism 12, or any desired number of panels could be held by providing a longer or shorter holding mechanism. The choice of the number of panels to be held is based primarily on ease of transporting of each holding mechanism 12 together with the requirement that the number of panels held be evenly divisible into the number of ganged stations. Thus, with holding mechanism 12, sets of five or six holding mechanisms 12 would be used with embroidery machines having twenty or twenty-four ganged stations respectively.

Figure 3:
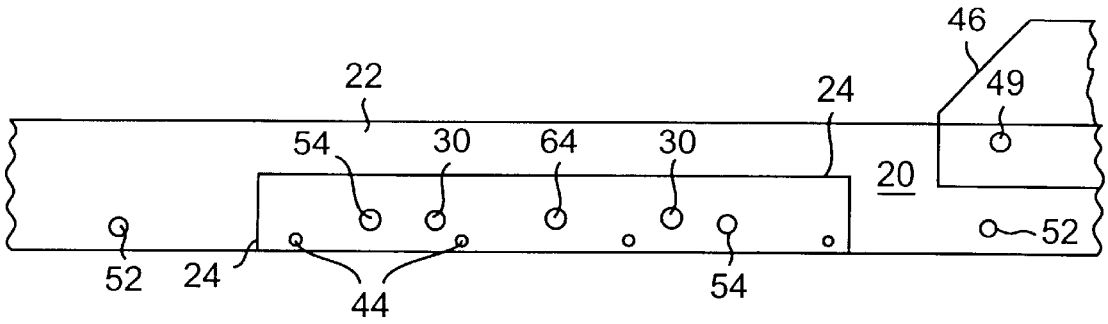
FIG. 3 is a top plan view of the base plate of the holding mechanism depicted in FIG. 1 with additional elements depicted in phantom.
Figure 4:
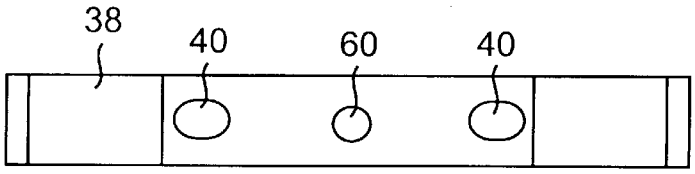
FIG. 4 is a top plan view of the bent spring of the holding mechanism depicted in FIG. 1.
Figure 5:
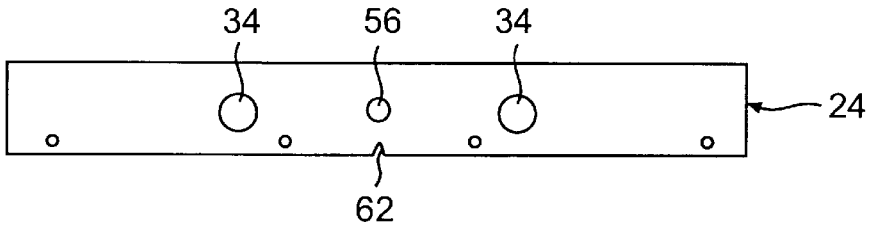
FIG. 5 is a top plan view of the clamp bar of the holding mechanism depicted in FIG. 1.
Figure 6:
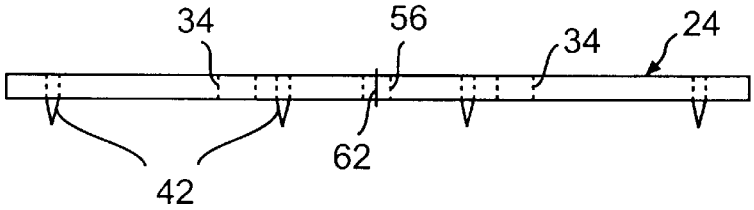
FIG. 6 is a front elevation view of the clamp bar of the holding mechanism depicted in FIG. 5.

Each holding mechanism 12 is designed to hold a plurality (four) of panels 16 at predetermined positions corresponding to the preset positions of the ganged embroidery stations of the automated embroidery machine. Holding mechanism 12 includes an elongate base plate 20 made of chromium steel or the like and having an upper face 22 as shown in greater detail in FIG. 3. A plurality of elongate clamp bars 24 also made of CR steel or the like extend axially along base plate 20 and are spaced according to the predetermined positions along base plate 20. A clamp bar 24 is shown in greater detail in FIGS. 4–5, and each clamp bar 24 is mounted by a mounting means 26 for movement toward and away from base plate 20. Mounting means 26 is conveniently comprised of two associated and spaced clamp posts 28 mounted axially along upper face 22 of base plate 20. For easy mounting, clamp posts 28 are preferably threaded bolts which are received in associated threaded holes 30 of base plate 20. Each clamp post 28 includes a head 32, which conveniently is the head of the bolt. To provide for relative movement, each clamp bar 24 includes two holes 34 which are slightly larger in diameter than associated clamp posts 28 passing therethrough.

Holding mechanism further includes a biasing means 36 for biasing each associated clamp bar 24 against upper face 22 of base plate 20. Biasing means 36 preferably includes a clamp spring in the form of a bent spring 38 made of spring stock. Bent spring 38 includes elongated holes 40 therein so that bent spring 38 can be located between heads 32 of clamp posts 28 and the associated clamp bar 24. It will be appreciated that bent spring 38 normally biases the associated clamp bar 24 securely against upper face 22 of base plate 20. In addition, in order to more securely hold panel 16 therebeneath, each clamp bar 24 also includes a series (four are depicted) of depending pins 42 located along an axial side thereof. Base plate 20 also includes matching holes 44 beneath depending pins 42 so that pins 42 can pierce though a part of panel 16 to be trimmed off or hidden later and be received in associated holes 44 to positively hold panel 16 in place.

As noted above, each holding mechanism 12 is designed to hold a plurality of panels 16 at predetermined positions of the ganged embroidery stations of the automated embroidery machine. Holding mechanism 12 is held in place by use of two nylon blocks 46 attached to base plate 20 at predetermined locations using suitable bolts received in threaded holes 49 (only one of which is shown) of base plate 20. Attached to each block 46 is a magnetic contact plate 48 of CR steel or the like by which holding mechanism 12 is magnetically but detachably held in the automated embroidery machine at the predetermined proper location. Base plate 20 also includes respective first and second holding posts 50 located adjacent each axial end of each clamp bar 24. Holding posts 50 are conveniently bolts screwed into threaded holes 52 of base plate 20. Beneath each clamp bar 24, base plate 20 also includes two lift holes 54 which are axially spaced from one another and symmetrically with respect to clamp bar 24. Each clamp bar 24 also includes a central threaded hole 56 in which a drive post 58 in the form of a bolt is located. Drive post 58 extends upwards through hole 60 in bent spring 38 so that bent spring 38 moves freely relative to drive post 58. A centering notch or line 62 is further provided on the front edge of each clamp bar 24 as shown, which centering notch 62 aligns with a centering hole 64 therebeneath in base plate 20.

With reference again to FIGS. 1 and 2, changing table 14 is conveniently a wood table and includes an elongate track 70 which is designed to slidably receive holding mechanism 12 in a slot 71 thereof so that upper face 22 is flush with a top 72 of table 14. Conveniently, track 70 is made of nylon and is embedded in top 72 of table 14. Positioned along track 70 is a changing station 74 at which an embroidered panel 16 is removed from beneath an associated clamp bar 24 thereat and at which a new panel 16 to be embroidered is located beneath clamp bar 24. In order to retain holding mechanism 12 in slot 71 of track 70 as this changing takes place, a retaining means 76 is used. Retaining means 76 includes first and second fluid actuators 78 mounted above track 70 by suitable brackets 80 made of HR steel or the like and secured by suitable screws to top 72 of table 14. Brackets 80 provide clearance for blocks 48 of holding mechanism 12 to pass thereby as holding mechanism 12 is moved in slot 71 of track 70. When holding mechanism 12 is properly positioned with a clamp bar 24 in changing station 74, plungers 82 (including brass ends 83 integrally threaded thereon) of actuators 78 are moved to positively press vertically against holding posts 50 of holding mechanism 12. While holding posts 50 are optionally part of retaining means 76, holding posts 50 could be eliminated so that plungers 82 directly contact upper face 22 of base plate 20 instead. However, by use of holding posts 50, a shorter reach of plungers 82 is required.

Figure 2:
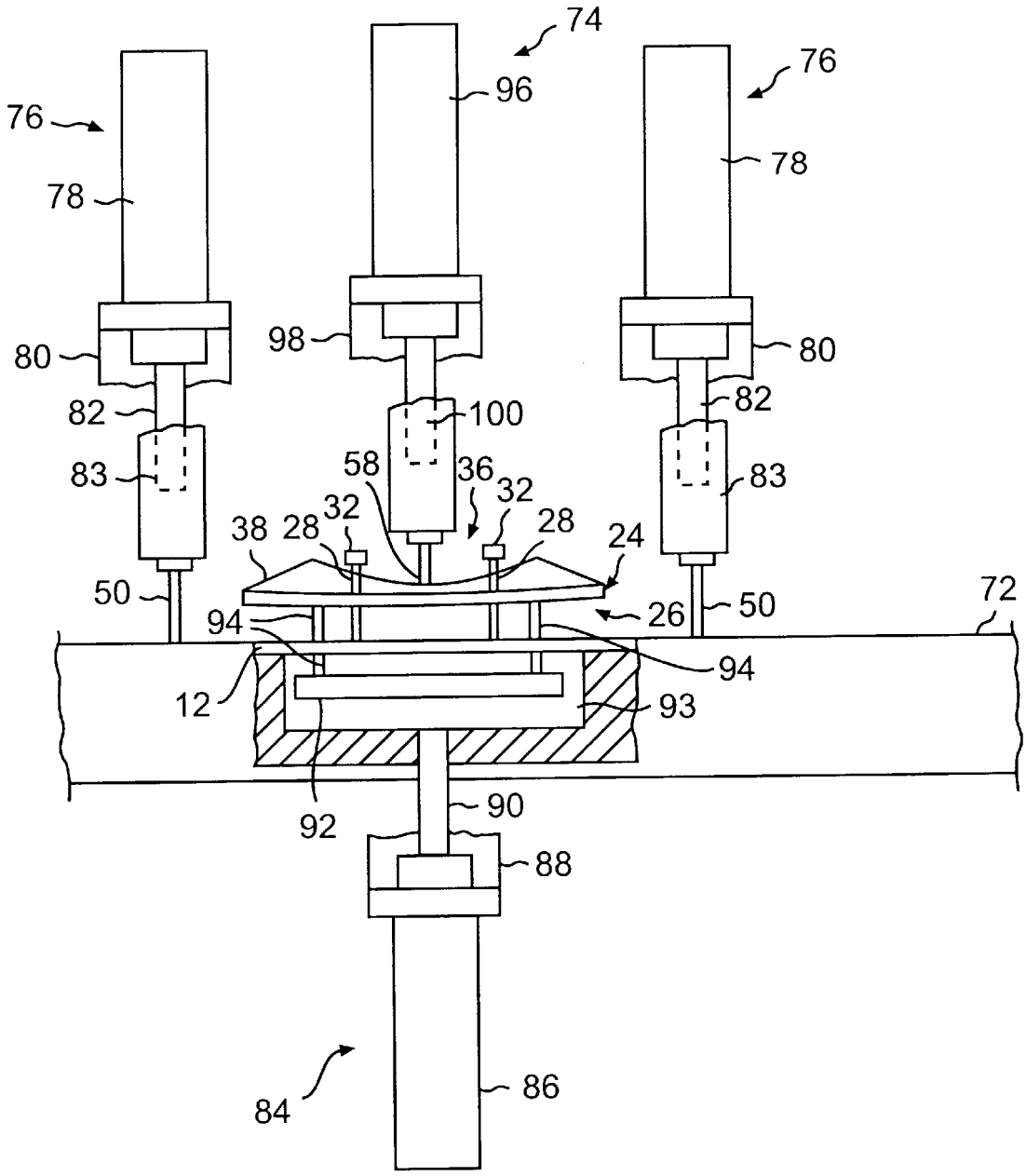
FIG. 2 is a front view with a part cut away of the changing system depicted in FIG. 1.

Also located at changing station 74 is a lifting means 84. Lifting means 84 includes a fluid actuator 86 attached to an underside of table 14 by a bracket 88 (only partially shown in FIG. 2, but similar to brackets 80). As best shown in FIG. 2, actuator 86 includes a plunger 90 having a free end to which a cross member 92 of CR steel or the like is threadably attached. Cross member 92 is located in a cutout 93 provided in table 14 at changing station 74 below base plate 20. Extending upwardly from a threaded engagement with cross member 92 are a pair of lift rods 94. Lift rods 94 pass upwardly and freely through holes 54 in base plate 20 when actuator 86 is actuated to engage the underside of clamp bar 24 at changing station 74 and then to move the clamp bar 24 to the raised position shown in FIG. 2. It will be appreciated that the tips of lift rods 94 remain extended slightly into slot 71 of track 70 when plunger 90 is returned to the withdrawn position. When in this slightly extended position, base plate 20 is easily manually moved thereover until these tips seat into an associated pair of lift holes 54. Thus, the tips of lift rods 94 act as locating detents for holding mechanism 12 to positively and easily locate holding mechanism with a selected clamp bar properly positioned in changing station 74.

In the preferred embodiment, changing table 14 further includes a drive fluid actuator 96 located between first and second retaining actuators 78. Drive actuator 96 is mounted to top 72 of table 14 by a bracket 98 (similar to brackets 80) to be positioned directly over drive post 58 of the underlying clamp bar 24 located in changing station 74. When actuator 96 is positioned with plunger 100 (including the integral brass end shown) in the withdrawn position, drive post 58 is raised with clamp bar 24 to a position just short of, or in slight engagement therewith. After clamp bar 24 is lowered back onto base plate 20 with a new panel therebetween, drive actuator 96 is actuated to drive plunger 100 into drive post 58 which in turn drives drive pins 42 of clamp bar 24 into the new panel 16.

In operation, changing system 10 functions in the following manner. After a holding mechanism 12 has been placed in an embroidery machine and panels 16 attached thereto embroidered at the ganged stations, the embroidery machine is shut down or idled (for safety) and (each) holding mechanism 12 is manually removed therefrom. This is easily accomplished since (each) holding mechanism 12 is held in position on the embroidery machine by magnetic contact with contact plates 48 on blocks 46. Holding mechanism 12 is then manually moved into slot 71 of track 70 in changing table 14, preferably with the rightmost clamp bar 24 to the left of changing station 74. Holding mechanism 12 is then manually moved along track 70 until the rightmost clamp bar is properly located in changing station 74. This is easily felt by the operator as lift holes 54 of base plate 20 on either side of clamp bar 24 receive the tips of lift rods 94 therein. As noted above, thc tips of lift rods 94 act as locating detents by extending slightly into slot 71.

Once the rightmost clamp bar 24 (and associated embroidered panel 16) is properly positioned in changing station 74, the operator pushes a suitable foot pedal or the like associated with the control of actuators 78 of retaining means 76. This causes plungers 82 to extend from actuators 78 so that brass ends 83 thereof press positively onto holding posts 50 of base plate 20. The pressing force of actuators 78 thus positively holds base plate 20 in slot 71 of track 70, preventing both axial and upward movement in particular.

With base plate 20 of holding mechanism 12 secured in place, the operator then pushes another foot pedal or the like control mechanism to cause lifting means 84 to raise clamp bar 24 upwards against the force of bent spring 38 which is bent by engagement with heads 32 of clamp posts 28 (see FIG. 2). This lifting ultimately moves clamp bar 24 away from base plate 20, which is held in position by retaining means 76. This lifting occurs as the result of the plunger 90 of actuator 86 being extended, so that cross member 92 and lift rods 94 are raised inside of cutout 93 causing clamp bar 24 engaged by lift rods 94 to similarly be raised. In the raised position, embroidered panel 16 is easily removed from between clamp bar 24 and base plate 20, even if pins 42 pierce panel 16. After removal of the embroidered panel 16, a new panel 16 to be embroidered is then located in between clamp bar 24 and base plate 20 in place of the removed panel 16. It will be appreciated that centering of the new panel 16 is facilitated by the use of notch 62 on the edge of clamp bar 24 or centering hole 64 in base plate 20, with the edge of the new panel 16 being aligned with or placed against the adjacent sides of lift rods 94, drive post 58 and holding posts 50 (if the panel 16 is axially long enough, as panels 16 shown are).

After placement of the new panel 16, another foot pedal or like control mechanism is actuated by the operator to cause actuator 86 to move cross member 92 and lift rods 94 attached thereto back to the withdrawn position (with the tips of lift rods acting as detents as noted above). As the lifting force is removed, bent spring 38 returns clamp bar 24 back to engagement with base plate 20. In addition, at the same time that lift rods 94 are withdrawn, drive actuator 96 is actuated to cause plunger 100 to be driven downward and to strike drive post 58. The striking of drive post 58 causes pins 42 of clamp bar 24 to be driven through new panel 16 and into the underlying holes 44 of base plate 20, so that new panel 16 is thus very securely held in place.

With new panel 16 now securely held in place, the operator moves the next clamp bar 24 into position in changing station 74 to repeat the changing process of an embroidered panel 16 with a new panel. This changing process is then repeated for each clamp bar 24 in turn until holding mechanism 12 has all new panels 16 ready to be embroidered. Where the embroidery machine takes a plurality of holding mechanisms 12, it will be appreciated that other holding mechanisms 12 are put through the same changing process, until a new set of holding mechanisms 12 is ready to be placed into the embroidery machine. It will also be appreciated that this changing process takes place while the embroidery machine is operating to embroider new panels 16 already loaded into the embroidery machine, so that the only down time of the embroidery machine is the time required to exchange the set of holding mechanisms 12 with embroidered panels 16 for holding mechanisms 12 with new panels 16. This exchanging time is relatively short, due to the holding mechanisms 12 only being magnetically held in the embroidery machine. It will further be appreciated that the time spent to embroider panels 16 is typically longer than the time it takes for the changing process of the set of holding mechanisms, so that only two sets of holding mechanisms 12 are required, and potentially one operator may be able to handle two or more embroidery machines. A storage place for holding mechanisms waiting to be changed and already changed also makes the process more efficient, as well appreciated by those of skill in the art.

While the present invention has been described with respect to exemplary embodiments thereof, it will be understood by those of ordinary skill in the art that variations and modifications can be effected within the scope and spirit of the invention.

We claim:

1. An embroidery panels holding mechanism for an automated embroidery mechanism comprising:

an elongate base plate having an upper face;

a plurality of pairs of associated and spaced holding posts, said pairs being mounted axially along said upper face of said base plate and said associated holding posts extending upwardly from said upper face;

two associated and spaced clamp posts mounted axially along said upper face of said base plate between said associated holding posts of each said pair, said clamp posts extending upwardly from said upper face and having a respective head;

an elongate clamp bar extending axially along said upper face of said base plate between said associated holding posts of each said pair, said clamp bar being mounted for sliding movement upwardly along associated said clamp posts;

a drive post mounted to each said clamp bar between each said two associated clamp posts, each said drive post extending upwardly from an associated said clamp bar and having a respective head; and a clamp spring mounted between said heads of associated ones of said clamp posts such that said clamp bar is biased against said upper face of said base plate to hold an embroidery panel in place therebetween and is movable away from said upper face against the biasing of said clamp spring to release the embroidery panel.

2. An embroidery panels holding mechanism as claimed in claim 1:

wherein each said clamp bar includes a plurality of pins extending toward said upper face of said base plate which pierce the embroidery panel when said clamp bar is biased against said upper face; and wherein said base plate includes a plurality of holes in which said pins of each said clamp bar are received.

3. An embroidery panels changing system for an automated embroidery machine having a plurality of ganged embroidery stations comprising:

a holding mechanism for holding a plurality of panels at predetermined positions corresponding to the positions of the ganged embroidery stations of the embroidery machine, said holding mechanism including an elongate base plate having an upper face, a plurality of elongate clamp bars extending axially and spaced along said upper face of said base plate, a mounting means for mounting each said clamp bar for movement toward and away from said upper face, and a biasing means for biasing each said clamp bar against said upper face; and a changing table remote from the embroidery machine having a changing station at which embroidery panels already embroidered can be removed from said holding mechanism and embroidery panels to be embroidered can be placed in said holding mechanism, said table including an elongate track, said base plate being received on said track for movement therealong;

a retaining means for retaining said base plate immovably along said track with one of said clamp bars at the changing station;

a lifting means for moving said one of said clamp bars at the changing station (a) away from said upper face of said base plate and against said biasing means so that an embroidery panel already embroidered can be removed therebetween and an embroidery panel to be embroidered can be placed between the lifted said clamp bar and said upper face and (b) back against said upper face so that the panel to be embroidered is trapped therebetween.

4. An embroidery panels changing system as claimed in claim 3:

wherein said base plate of said holding mechanism includes two spaced lift holes provided beneath each said clamp bar; and wherein said lifting means of said changing table includes an actuator attached to an underside of said table at the changing station, said actuator having a plunger and two spaced lift rods attached thereto, movement of said plunger upwards causing said lift rods to pass through said lift holes and engage an underside of said clamp bar to raise said clamp bar.

5. An embroidery panels changing system as claimed in claim 4:

wherein said elongate track is a slot in said table along which said base plate is manually moved; and wherein said lift rods are returned by said actuator to a position where tips of said lift rods remain in said slot to act as locating detents in conjunction with said lift holes of said base plate as said base plate is manually moved along said slot.

6. An embroidery panels changing system as claimed in claim 3:

wherein said retaining means of said changing table includes first and second actuators located on opposite axial sides of the changing station, each said actuator including a plunger which extends downwards to press said base plate against said table and thus to hold said base plate immovably along said track.

7. An embroidery panels changing system as claimed in claim 6:

wherein said base plate of said holding mechanism includes first and second holding posts mounted to said base plate on opposite axial sides of each said clamp bar, associated said first and second holding posts extending upwardly from said upper face being spaced to be engaged by said plungers of respective said first and second actuators when an associated said clamp bar is at the changing station.

8. An embroidery panels changing system as claimed in claim 3:

wherein each said clamp bar of said holding mechanism includes depending pins for engaging an associated panel; and wherein said table further includes an actuator having a plunger which engages said clamp bar after said clamp bar is moved back against said upper face with the panel to be embroidered therebeneath to drive said pins into the panel to be embroidered.

9. An embroidery panels changing system as claimed in claim 8, wherein said base plate of said holding mechanism includes a plurality of holes in which said pins of each said clamp bar are received.

10. An embroidery panels changing system as claimed in claim 3, wherein said mounting means of said holding mechanism includes, for each associated said clamp bar, two associated and spaced clamp posts mounted axially along said upper face of said base plate, said clamp posts extending upwardly from said upper face through the associated said clamp bar and having respective heads.

11. An embroidery panels changing system as claimed in claim 10:

wherein said biasing means of said holding mechanism includes, for each associated said clamp bar, a bent spring located between the respective heads of said clamp posts and the associated said clamp bar.

12. An embroidery panels changing system as claimed in claim 5:

wherein said retaining means of said changing table includes first and second actuators located on opposite axial sides of the changing station, each said actuator including a plunger which extends downwards to press said base plate against said table and thus to hold said base plate immovably along said track.

13. An embroidery panels changing system as claimed in claim 12:

wherein said base plate of said holding mechanism includes first and second holding posts mounted to said base plate on opposite axial sides of each said clamp bar, associated said first and second holding posts extending upwardly from said upper face being spaced to be engaged by said plungers of respective said first and second actuators when an associated said clamp bar is at the changing station.

14. An embroidery panels changing system as claimed in claim 13:

wherein each said clamp bar of said holding mechanism includes depending pins for engaging an associated panel; and wherein said table further includes an actuator having a plunger which engages said clamp bar after said clamp bar is moved back against said upper face with the panel to be embroidered therebeneath to drive said pins into the panel to be embroidered.

15. An embroidery panels changing system as claimed in claim 14, wherein said base plate of said holding mechanism includes a plurality of holes in which said pins of each said clamp bar are received.

16. An embroidery panels changing system as claimed in claim 15, wherein said mounting means of said holding mechanism includes, for each associated said clamp bar, two associated and spaced clamp posts mounted axially along said upper face of said base plate, said clamp posts extending upwardly from said upper face through the associated said clamp bar and having a respective head.

17. An embroidery panels changing system as claimed in claim 16:

wherein said biasing means of said holding mechanism includes, for each associated said clamp bar, a bent spring located between the respective heads of said clamp posts and the associated said clamp bar.

* * * * *